US007188569B2

(12) United States Patent
Shen

(10) Patent No.: US 7,188,569 B2
(45) Date of Patent: Mar. 13, 2007

(54) CRIMINAL ARRESTING ASSEMBLY

(76) Inventor: Hsien-Ho Shen, No. 6, Lane 61, Minghsing St., Kueishan Hsiang, Taoyuan Hsien (TW)

( * ) Notice: Subject to any disclaimer, the term of this patent is extended or adjusted under 35 U.S.C. 154(b) by 183 days.

(21) Appl. No.: 10/934,287

(22) Filed: Sep. 3, 2004

(65) Prior Publication Data

US 2006/0048688 A1 Mar. 9, 2006

(51) Int. Cl.
*E05G 5/00* (2006.01)

(52) U.S. Cl. ..... 109/3; 70/16; 43/59

(58) Field of Classification Search ..... 70/15–18; 109/1 R, 2–5, 9; 482/93, 94, 104; 43/59; 105/394

See application file for complete search history.

(56) References Cited

U.S. PATENT DOCUMENTS 983,663 A * 2/1911 White ..... 160/3
1,041,463 A * 10/1912 Griffin ..... 43/59
1,368,543 A * 2/1921 Burghart ..... 43/59
1,428,003 A * 9/1922 Chambers et al. ..... 160/19
1,807,944 A 6/1931 Thibault
2,053,035 A * 9/1936 Jackson et al. ..... 43/59
3,148,640 A * 9/1964 Billi ..... 109/5
3,965,827 A 6/1976 Reeves ..... 109/3
4,947,764 A * 8/1990 Rohr ..... 109/3
5,048,825 A * 9/1991 Kelly ..... 482/94
6,219,959 B1 * 4/2001 Hsieh ..... 43/59
6,402,665 B1 * 6/2002 Edward ..... 482/93

FOREIGN PATENT DOCUMENTS

DE 19825506 A1 1/2000
RU 2140800 C1 11/1999
WO WO99/62441 12/1999

* cited by examiner

*Primary Examiner*—Lloyd A. Gall
(74) *Attorney, Agent, or Firm*—James H. Walters

(57) ABSTRACT

A criminal arresting method includes preparing a frame assembly, activating a first weight releasing device to allow a first weight to fall inside the frame assembly, activating reducing of size of a first loop inside the frame assembly, activating a second weight releasing device to allow a second weight to fall relative to the frame assembly and activating reducing of size a second loop inside the frame assembly.

21 Claims, 12 Drawing Sheets

CRIMINAL ARRESTING ASSEMBLY

BACKGROUND OF THE INVENTION

1. Field of the Invention

The present invention relates to an assembly for arresting a criminal, and more particularly to the assembly for arresting a criminal which is able to seize the suspect's chest and feet to prevent the suspect from fleeing.

2. Description of Related Art

Throughout the world, the proliferation of armed robbery, especially the use of firearms against financial institutions, has been on the increase for many years. One reason for this is the apparent ease with which the criminals can rob banks, convenience stores and so on. In fact, staff at such establishments are generally told to simply comply with the criminals' demands, and the general public is also cautioned against any acts of heroism. The irony is that criminals probably feel encouraged to commit such crimes due to the tolerance of the authorities.

Generally, security guards are stationed inside a financial or transaction business center to prevent any unexpected accidents. However, due to the rampant gun smuggling and the infested black-market, almost every outlaw owns a powerful pistol. It is known that every policeman carries a standard issued 90 mm handgun, but not every security guard is equipped with a handgun, some may even have a stick and a flashlight as the standard issued equipment. For those business centers where there are no security guards to safeguard the customers as well as to the properties from the potential danger, the outlaws may easily getaway without any attempt from anyone in the business centers trying to stop them. Even when there are some brave passersby trying to stop the outlaws, the passersby will be warned afterward not to do things to jeopardize one's own life. Therefore, it is commonly seen that the convenient store keepers are advised to let the robbers take the money and run. It's also advised not to do things to agitate the outlaws in order to save one's own life. The passive attitude toward the outlaws seems to encourage the crime and thus positive measures are to be taken to effectively stop crime rate increase.

To overcome the shortcomings, the present invention tends to provide an improved assembly for arresting a criminal to mitigate the aforementioned problems.

SUMMARY OF THE INVENTION

The primary objective of the present invention is to provide an improved assembly for arresting a criminal to effectively stop the escape of a criminal.

Another objective of the present invention is that the assembly for arresting a criminal is able to seize the criminal's chest and the feet such that even a still-armed criminal who has been arrested is not able to threaten anyone. Other objects, advantages and novel features of the invention will become more apparent from the following detailed description when taken in conjunction with the accompanying drawings.

DETAILED DESCRIPTION OF THE PREFERRED EMBODIMENT

Figure 1:
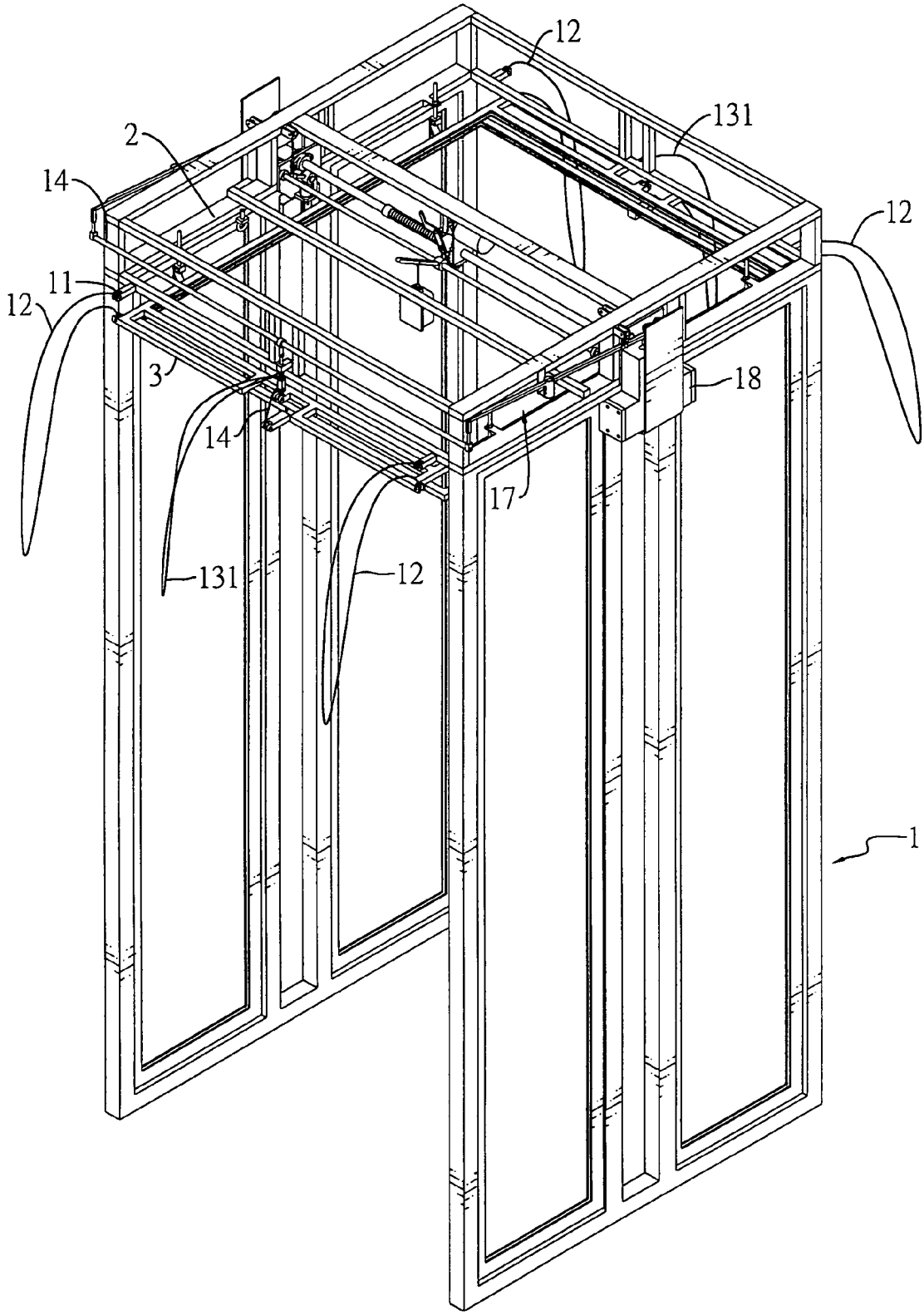
FIG. 1 is a perspective view of the arrest device of the present invention.
Figure 2:
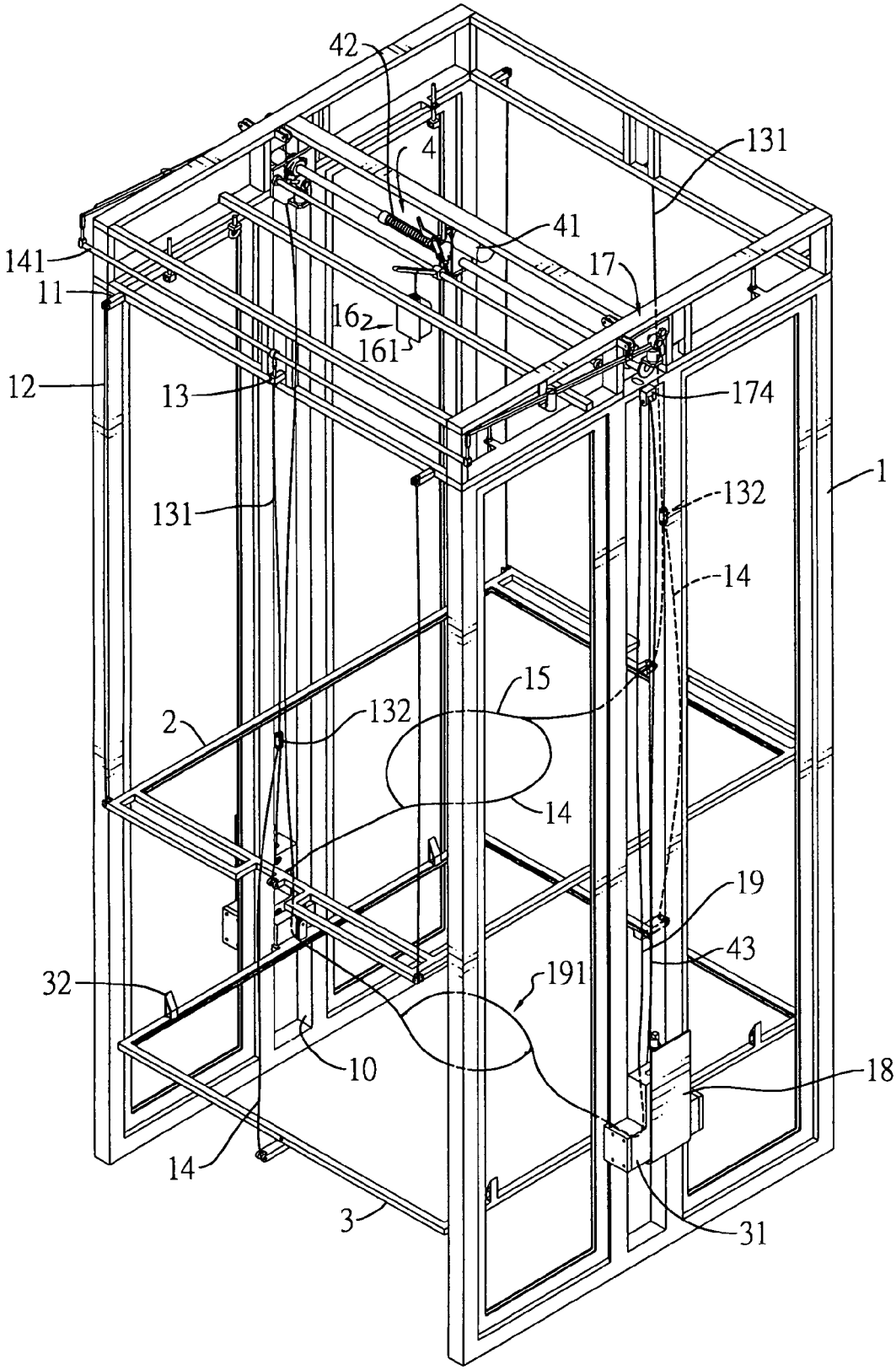
FIG. 2 is a schematic perspective view showing the full employment of the arrest device of the present invention so as to demonstrate the components of the present invention.

With reference to FIGS. 1 and 2, the arrest device configured in accordance with the present invention includes a main frame (1), an inner frame (2) slidably received in the main frame (1) and an outer frame (3) supporting the inner frame (2) and slidably received in the main frame (1).

The main frame (1) includes multiple columns and multiple rails mutually connected to the columns so as to form a substantially rectangular main frame. The main frame (1) has a pair of guiding tracks (10) oppositely formed on opposed sides of the main frame, multiple first rollers (11) each freely rotatably mounted on a top portion of the main frame (1) and having first wire (12) (four are shown in this embodiment) respectively extending downward from a corresponding one of the first rollers (11) to securely connect to ends of the inner frame (2) so as to support the inner frame (2). Two holes (13) are defined in opposed sides on the top portion of the main frame (1) and two second wires (131) are respectively extended downward from two driving rods (141) which are laterally mounted on top of the main frame (1). Each second wire (131) has a second roller (132) provided on a free end of the second wire (131) after the second wire (131) has been extended through a corresponding one of the holes (13) to connect to a third wire (14). Each third wire (14) has a first end securely connected to a side face of the outer frame (3) and a second end extending over the second roller (132) and extending through a side face of the inner frame (2). After two second ends of the two third wires (14) are extended over side faces of the inner frame (2), the two second ends of the two third wires (14) are combined to form a first loop (15).

From the above description, it is noted that the inner frame (2) is held by the first wires (12) and the outer frame (3) is suspended by the combination of the second wires (131) and the third wires (14) after the inner frame (2) and the outer frame (3) are released from the main frame (1).

Figure 3:
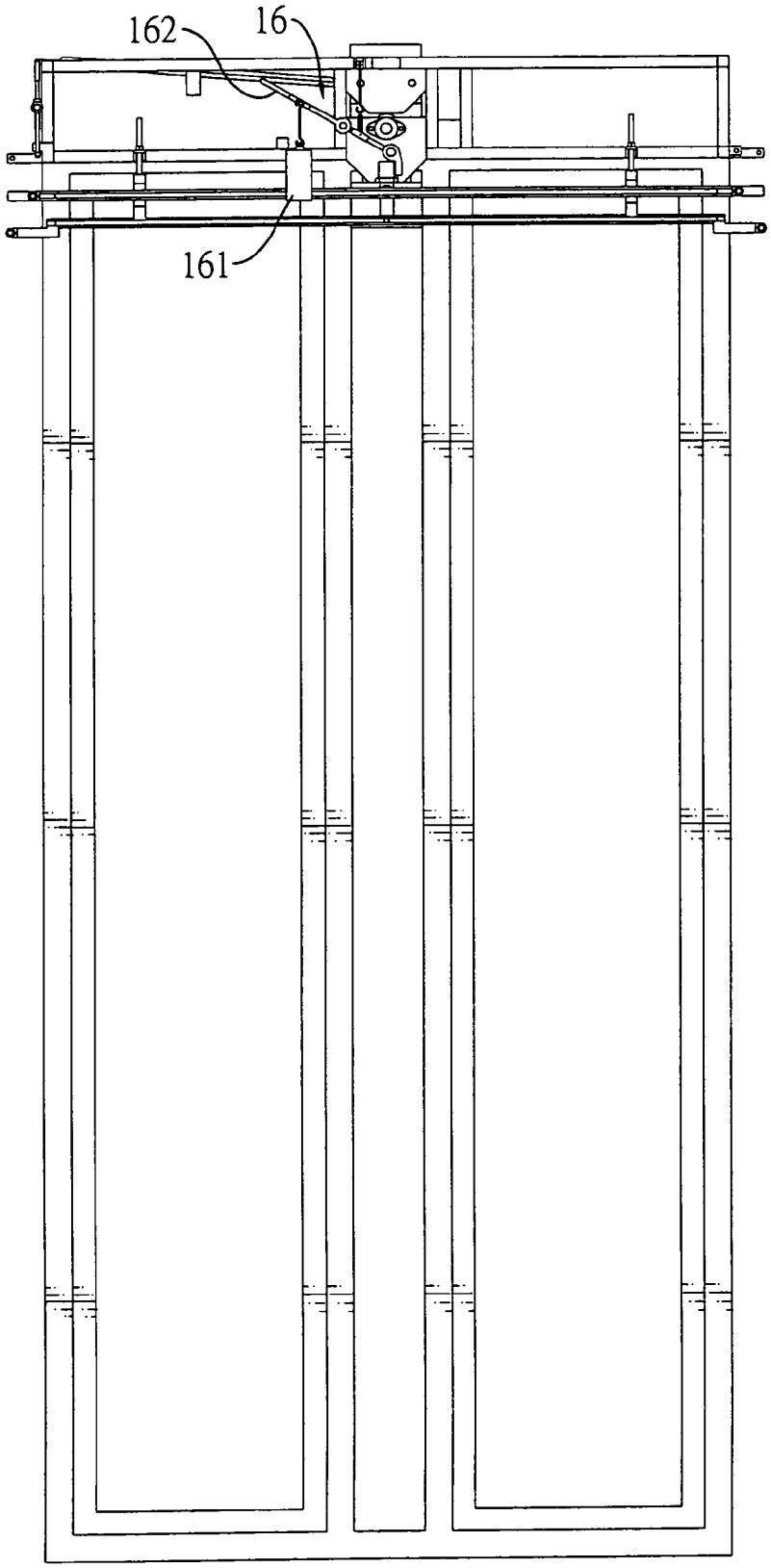
FIG. 3 is a side view showing the structure of the first weight releasing device.
Figure 4:
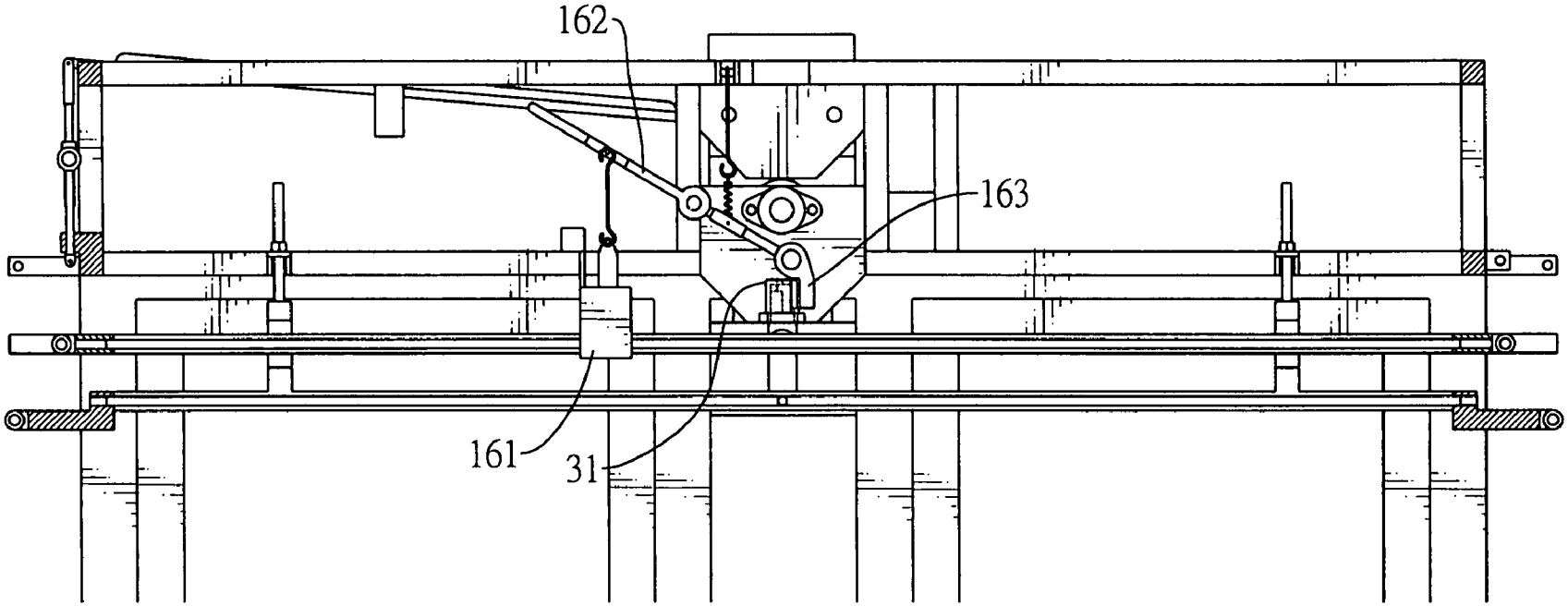
FIG. 4 is an enlarged schematic side view showing that the first weight is securely attached to the first weight releasing device.
Figure 5:
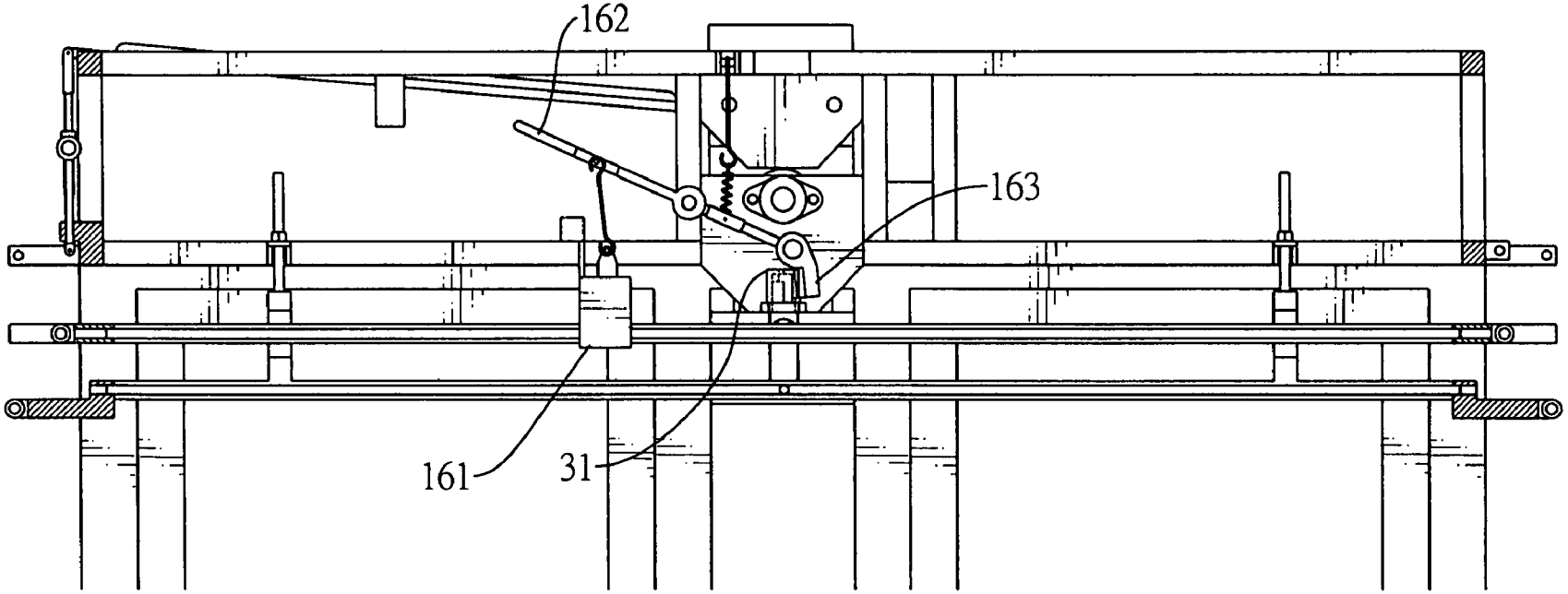
FIG. 5 is an enlarged schematic side view showing that the first weight is released by the first weight releasing device.
Figure 6:
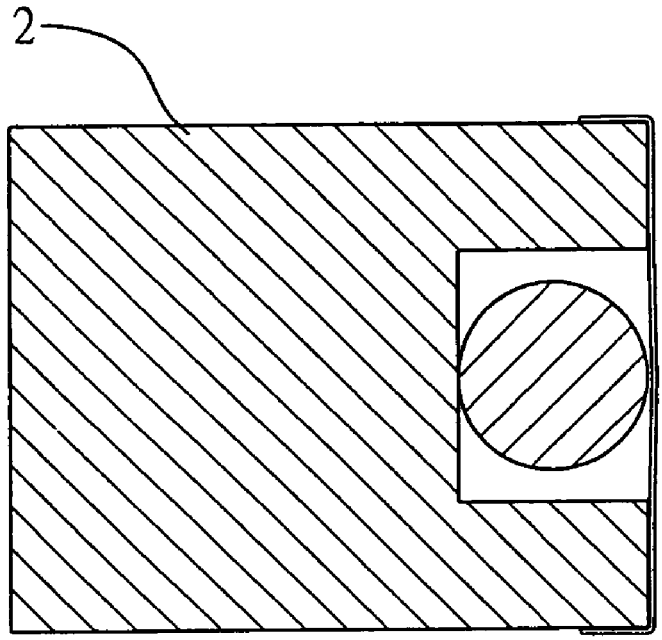
FIG. 6 is a cross sectional view showing the profile of the inner frame.

With reference to FIGS. 3, 4 and 5, to discuss the release mechanism of the main frame (1), it is crucial to learn that the outer frame (3) is provided with two first weights (31) (clearly shown in FIG. 8) integrally and respectively formed on opposed sides of the outer frame (3) and movably received in the guiding tracks (10) of the main frame (1). The main frame (1) has a first weight releasing device (16) to selectively clamp/release the first weight (31) of the outer frame (3). The first weight releasing device includes an electromagnetic valve (161) and a lever (162) pivotally mounted on the top portion of the main frame (1) and having a claw (163) formed on a free end of the lever (162) to correspond to and clamp the first weight (31). Thus when the electromagnetic valve (161) is not energized, the claw (163) is able to securely clamp the first weight (31) and when the electromagnetic valve (161) is energized, the lever (162) is attracted by the electromagnetic valve (161) and pivoted. After the lever (162) is pivoted, the claw (163) releases the first weight (31) to allow the first weight (31) to free fall relative to the main frame (1), as shown in FIG. 5. In order to conceal the first wire (12) and the second wire (131) when the arrest device of the present invention is not employed, the inner frame (2) has a U shaped cross section as indicated in FIG. 6.

Figure 7:
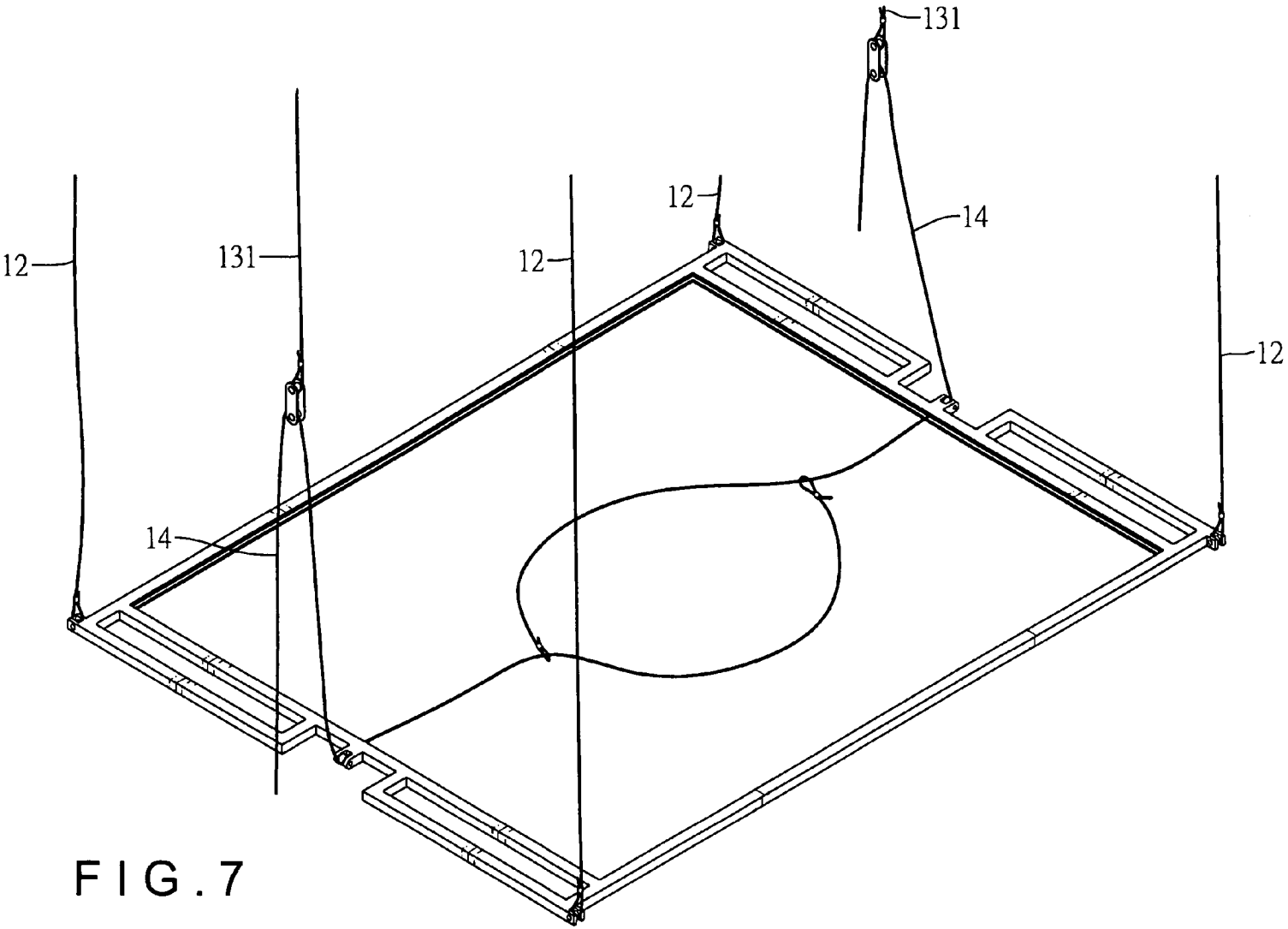
FIG. 7 is a schematic perspective view showing the employment of the inner frame.

With reference to FIG. 7 and still using FIG. 2 for reference, it is appreciated that when the inner frame (2) is released, the inner frame (2) is held by four first wires (12). Two second wires (131) are extended from opposed sides of the top portion of the main frame (1) to respectively connect to a second roller (132) and then a third wire (14) is extended downward to pass through the side face of the inner frame (2) and connected to the side face of the outer frame (3). Furthermore, the outer frame (3) has spacers (32) formed on the side faces of the outer frame (3) to space apart the outer frame from the inner frame (2) when the inner frame (2) and the outer frame (3) are restricted on the top portion of the main frame (1).

Figure 8:
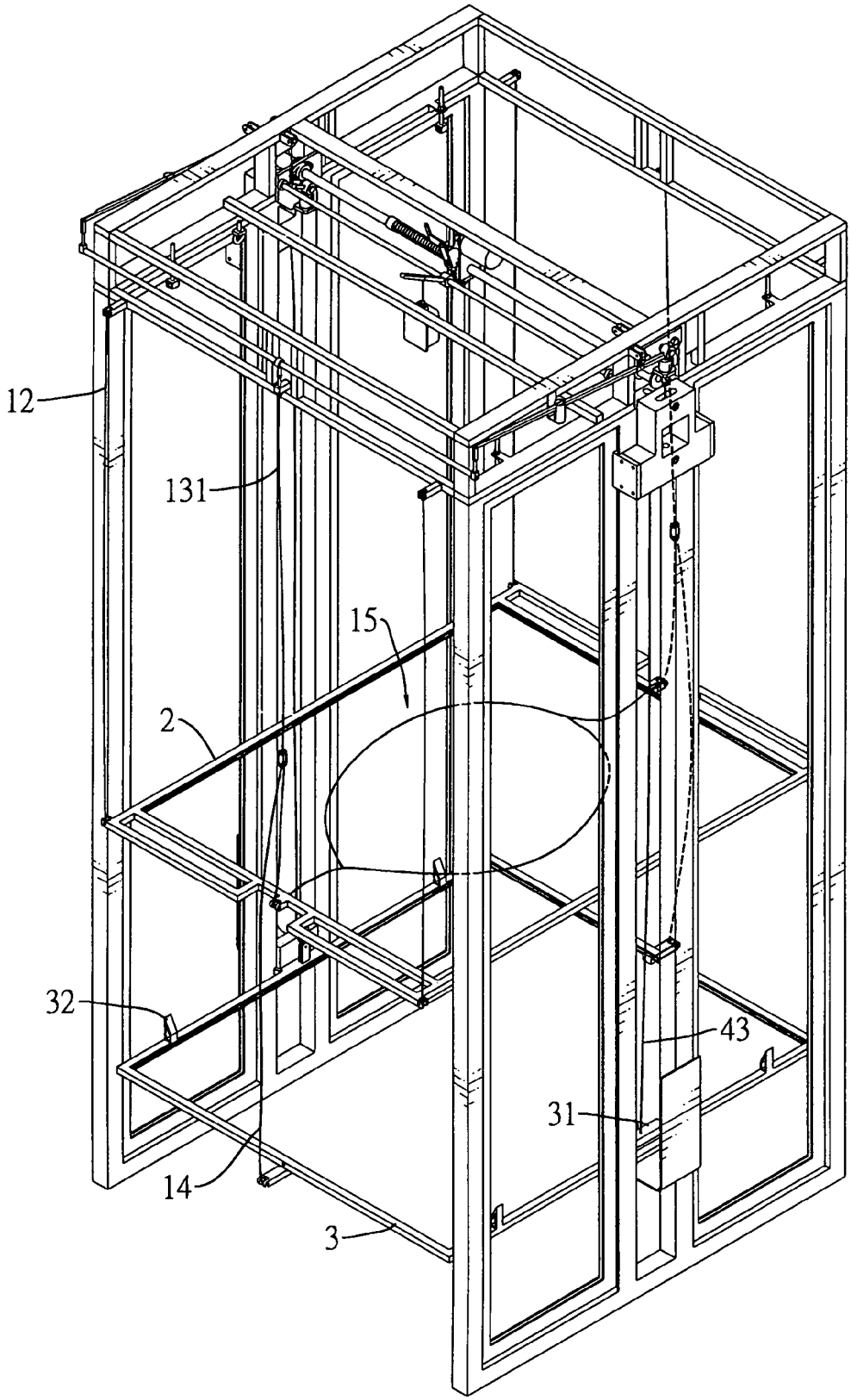
FIG. 8 is a schematic perspective view showing the employment of the inner frame and the outer frame inside the main frame without showing the deployment of the second loop for brevity.

With reference to FIG. 8, it is noted that when the first weight releasing device is activated to allow the claw (not shown in this drawing) to disengage from the first weight (31), the first weight (31) integrally formed on the opposed sides of the outer frame (3) as well as the outer frame (3) free falls from the top portion of the main frame (1). Due to the addition of the first weight (31) on the outer frame (3), the outer frame (3) has a falling speed greater than that of the inner frame (2) so that the inner frame (2) and the outer frame (3) are separated during their descents. Furthermore, due to the length limitation of the first wires (12) and the second wires (131), the inner frame (2) and the outer frame (3) are respectively stopped at a predetermined position. Of course, the position of the outer frame (3) is designed to be lower than that of the inner frame (2) inside the main frame (1). However, just before the outer frame (3) reached its designated position, the second ends of the two third wires (14) respectively having a previously designed length and extending through the side face of the inner frame (2) are pulled so that the first loop (15) is reduced.

Figure 9:
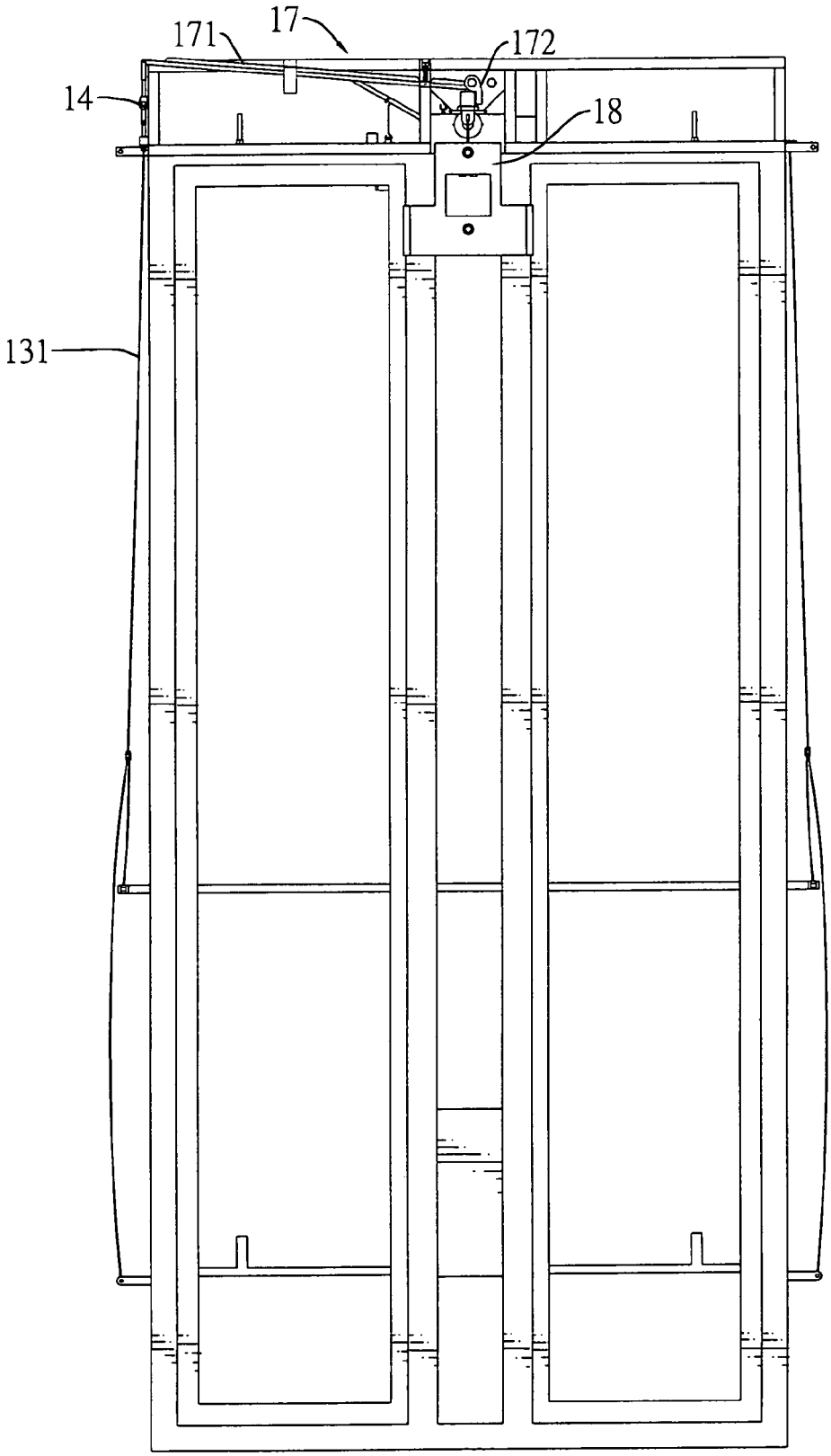
FIG. 9 is a side plan view showing the interrelationship between the second weight releasing device and the second weight.
Figure 10:
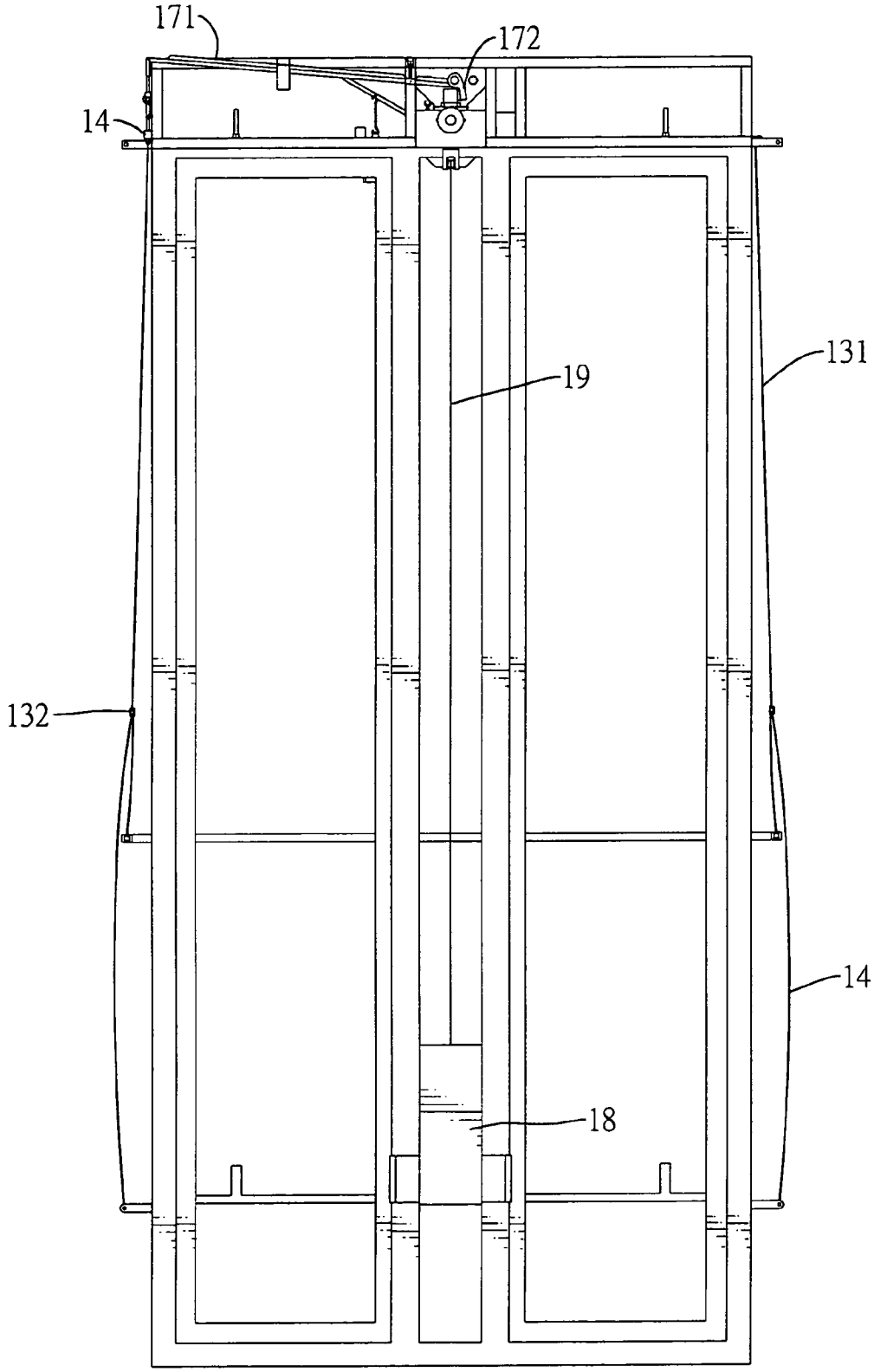
FIG. 10 is a side plan view showing that the second weight is released by the second weight releasing device.

With reference to FIGS. 9 and 10, it is to be appreciated that the main frame (1) further has two second weight releasing devices (17) respectively mounted on opposed side faces of the main frame (1) to respectively control movement of two second weights (18). Each second weight releasing device (17) includes the driving rod (141) extending across the top portion of the main frame (1), a driven rod (171) pivotally connected to one of the rails of the main frame (1) and having a first end fixedly connected to a distal end of the driving rod (141) and a second end provided with a second claw (172) to clamp the second weight (18). Further, it is noted from the depiction of FIG. 2 that a distal end of the second wire (131) is securely connected to the driving rod (141) so that the second wire (131) is able to control movement of the driving rod (141).

As previously described, after the outer frame (3) falls to the predetermined position, the second wire (131) is stretched by the weight of the outer frame (3) together with the first weight (31). The stretching force to the driving rod (141) forces the driving rod (141) to move, which causes the driven rod (171) to pivot simultaneously. When the driven rod (171) is pivoted, the second claw (172) releases clamping to the second weight (18) and thus the second weights (18) from opposed sides of the main frame (1) fall. Still further, the main frame (1) has two fourth wires (19) respectively provided on opposed sides of the main frame (1) and each having a first end securely connected to a top face of the corresponding second weight (18) after passing over a third roller (174) on the top portion of the main frame (1) and a second end passing through a corresponding one of the second weights (18) and a side face of the outer frame (3) to mutually form a second loop (191) inside the outer frame (3) with the second end of the other fourth wire (19), as shown in FIG. 2.

Figure 11:
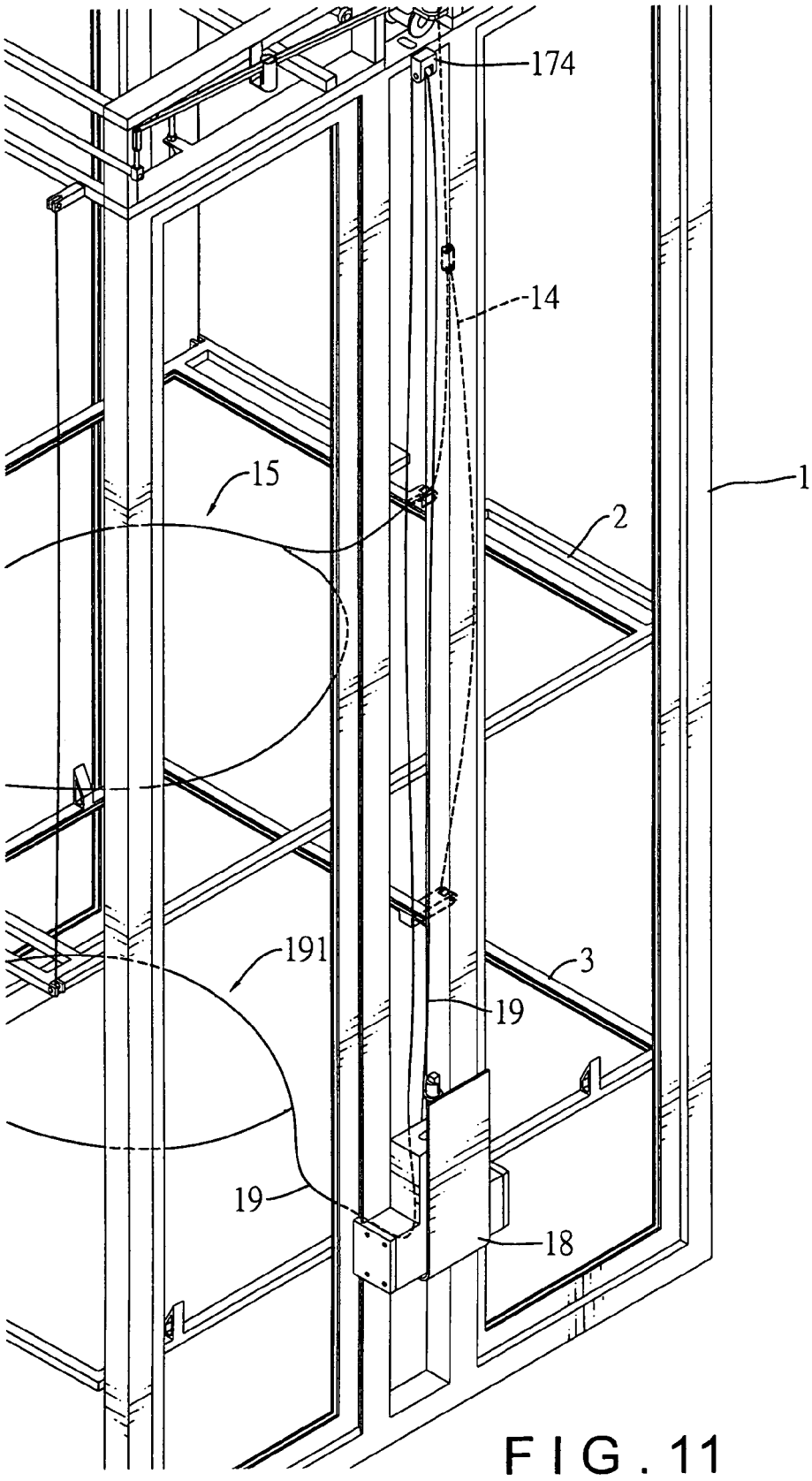
FIG. 11 is an enlarged partial perspective view showing how the second weight and first weight affect the arrest device to seize a suspect.

Referring to FIG. 2 and taking reference of FIG. 11, it is noted that the two third wires (14) forming the first loop (15) are connected to each other via a slipknot such that after the inner frame (2) reaches its predetermined position, the continued descent of the outer frame (3) causes the two third wires (14) to be extended, which reduces the first loop (15). When the second weights (18) are released by the second weight releasing device (17), the fourth wire (19) is stretched so that the second loop (191) is reduced.

Figure 12:
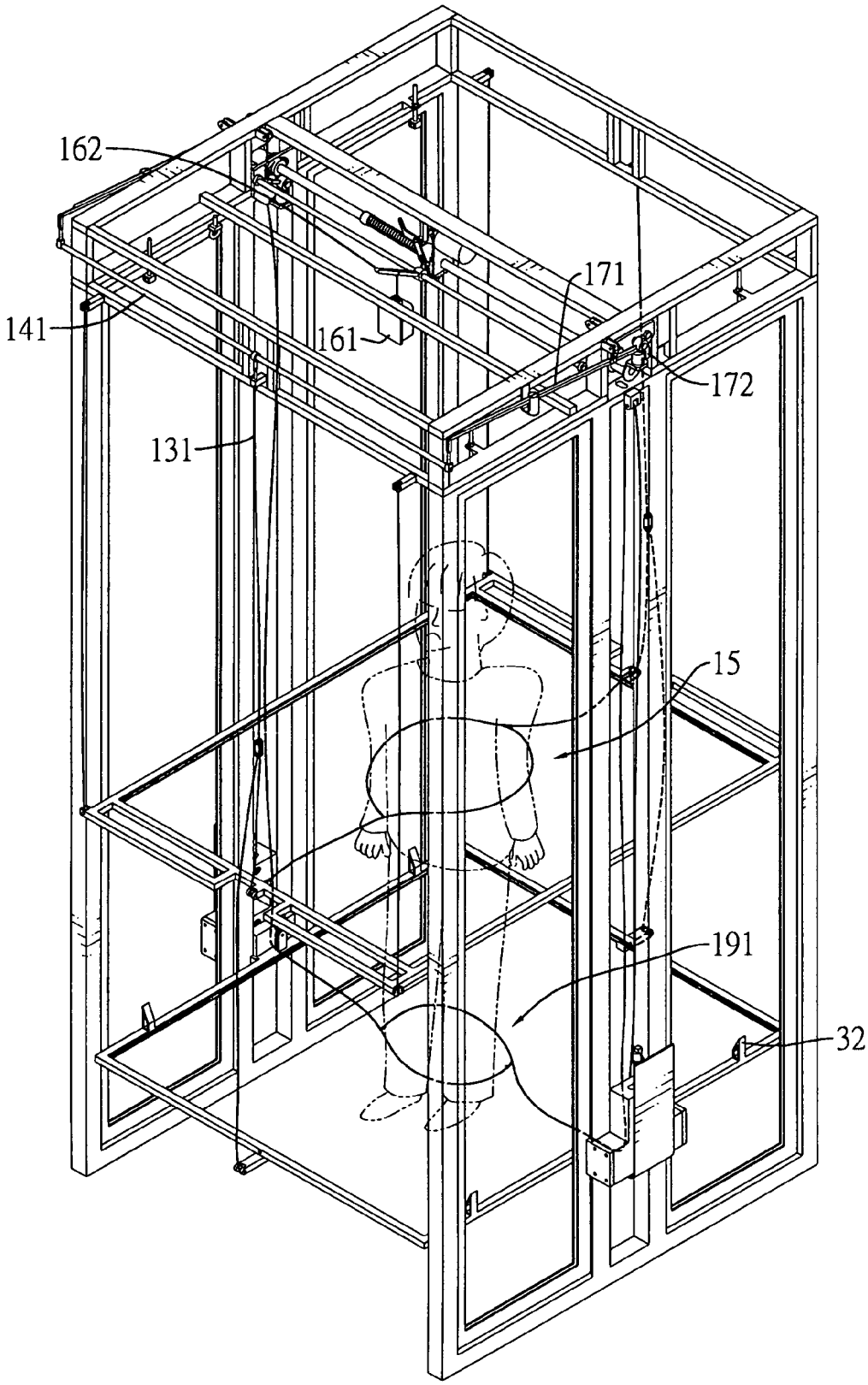
FIG. 12 is a schematic perspective view showing that a suspect is being detained by using the arrest device of the present invention.

With reference to FIG. 12, it is noted that when a person suspected of just committing a crime is trying to flee from the business center installed with the arrest device of the present invention and is walking right under the main frame (1), an operator is able to activate the first weight releasing device (16) to charge the electromagnetic valve (161) such that the lever (162) is attracted to pivot, which results in the release of the first weight (31) by the claw (163). Because the inner frame (2) is supported and spaced away from the outer frame (3) by the spacer (32) which is integrally formed on the outer frame (3) and the first weight (31) of the outer frame (3) is also integrally formed with the outer frame (3), the release of the first weight (31) allows the inner frame (2) and the outer frame (3) to fall inside the main frame (1). However, due to the addition of the first weight (31) in the outer frame (3), the outer frame (3) has a greater falling speed with respect to the inner frame (2). However, after the outer frame (3) reaches its designated position, the second wire (131) as well as the third wire (14) is stretched. Thus the first loop (15) composed of two distal ends from two opposite third wires (14) is reduced.

As stated earlier, when the second wire (131) is stretched, the driving rod (141) of the second weight releasing device (17) is pulled, which activates the driven rod (171) to pivot relative to the driving rod (141). Due to the pivotal movement of the driven rod (171), the second claw (172) formed on the free end of the driven rod (171) releases the clamp to the second weight (18). After the second weight (18) is released, the fourth wire (19) is stretched, which reduces the second loop (191). Because the first loop (15) and the second loop (191) are designated to seize the suspect's chest and feet respectively, after the first loop (15) and the second loop (191) are reduced, the suspect is securely arrested.

Furthermore, to return the inner frame (2) and outer frame (3) to their original positions, a reel (4) is mounted on the top portion of the main frame (1). The reel (4) includes a motor (41) and a threaded bolt (42), as shown in FIG. 2, operably connected to the motor (41) such that the motor (41) is able to drive the threaded bolt (42) to rotate. A fifth wire (43), as shown in FIGS. 2 and 8, has a first end securely wound around the threaded bolt (42) and a second securely connected to the first weight (31). Therefore, when the motor (41) is activated, the rotation of the threaded bolt (42) is able to lift the first weight (31), whereby in turn, the outer frame (3) and the inner frame (2) are lifted.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A criminal arresting method comprising:

preparing a frame assembly;

activating a first weight releasing device to allow a first weight to fall relative to the frame assembly;

activating reducing size of a first loop inside the frame assembly for enclosing a criminal's upper half;

activating a second weight releasing device to allow a second weight to fall relative to the frame assembly; and activating reducing size of a second loop inside the frame assembly for enclosing the criminal's lower half, whereby the criminal is arrested by the reduced first loop and the reduced second loop, wherein the frame assembly is composed of a main frame, an inner frame slidably received in the main frame and an outer frame supporting the inner frame and slidably received in the main frame, the inner frame is supported by and spaced away from the outer frame by spacers formed on side faces of the outer frame, wherein the first weight releasing device activating step includes energizing an electromagnetic valve;

pivoting a lever which is pivotally connected to a top portion of the main frame; and releasing the first weight, wherein the first loop size reducing activating step includes, stopping traveling of the inner frame by first wires each having a first end securely and fixedly connected to the top portion of the main frame and a second end securely connected to side faces of the inner frame;

stopping traveling of the outer frame by a combination of a pair of opposite second wires and a pair of opposite third wires, each second wire having a first end securely and fixedly connected to the top portion of the main frame and a second end provided with a first roller, and each third wire having a first end securely and fixedly connected to a side face of the outer frame and a second end passing over the first roller and a side face of the inner frame to form the first loop with the second end of the other third wire.

2. The method as claimed in claim 1, wherein the second weight releasing device activating step includes activating movement of a driving rod which is mounted on the top portion of the main frame; and pivoting a driven rod to allow a second claw formed on a free end of the driven rod to release clamping to the second weight.

3. The method as claimed in claim 1, wherein the second loop is composed of a pair of opposite fourth wires each having a first end securely and slidably connected to the top portion of the main frame and a second end passing through the second weight and a side face of the outer frame to form the second loop with the second end of the other fourth wire.

4. The method as claimed in claim 1, wherein the second ends of the opposite pair of third wires are connected to each other by a slipknot to form the first loop.

5. The method as claimed in claim 3, wherein the second ends of the opposite pair of fourth wires are connected to each other by a slipknot to form the second loop.

6. A criminal arresting assembly comprising:

a main frame;

an inner frame selectively held in a top portion of the main frame and movably received in the main frame;

an outer frame detachably connected to the top portion of the main frame to selectively support the inner frame and having a first weight formed on opposed sides of the outer frame;

an inner frame holding assembly sandwiched between the top portion of the main frame and side faces of the inner frame to support the inner frame when the inner frame is detached from the top portion of the main frame;

an outer frame holding assembly sandwiched between the top portion of the main frame and side faces of the outer frame to support the outer frame when the outer frame is detached from the top portion of the main frame;

a first weight releasing device mounted on the top portion of the main frame to selectively release the first weight of the outer frame;

a first activating device to activate the first weight releasing device so as to release the first weight;

a second weight releasing device mounted on the top portion of the main frame to selectively release the second weight;

a second activating device to activate the second weight releasing device so as to release the second weight;

a first loop received in the inner frame to have a first dimension when the first weight of the outer frame is securely attached by the first weight releasing device and a second dimension when the first weight of the outer frame is detached by the first weight releasing device; and a second loop received in the outer frame to have a first dimension when the second weight is attached by the second weight releasing device and a second dimension when the second weight is detached by the second weight releasing device.

7. The criminal arresting assembly as claimed in claim 6, wherein the inner frame holding assembly comprises multiple first wires each having a first end securely connected to the top portion of the main frame and a second end securely connected to the side faces of the inner frame so as to support the inner frame when the inner frame is away from the top portion of the main frame.

8. The criminal arresting assembly as claimed in claim 7, wherein the first weight releasing device comprises a lever movably positioned between a first position and a second position on the top portion of the main frame and a first claw formed on a distal end of the lever to attach to the first weight when the lever is at the first position and to detach the first weight when the lever is at the second position.

9. The criminal arresting assembly as claimed in claim 8, wherein the first activating device is an electromagnetic valve to attract the lever to allow the lever to pivot between the first position and the second position.

10. The criminal arresting assembly as claimed in claim 9, the second weight releasing device comprises a driving rod mounted across the top portion of the main frame, a driven rod securely connected to the driving rod and movable between a first position and a second position and a second claw formed on a free end of the driven rod to attach the second weight when the driven rod is at the first position and detach the second weight when the driven rod is at the second position.

11. The criminal arresting assembly as claimed in claim 10, wherein the second activating device includes two opposite second wires each having a first end securely connected to the driving rod and a second end in connection with the outer frame holding assembly so as to receive weight of the outer frame.

12. The criminal arresting assembly as claimed in claim 11, wherein the first loop is composed of two opposite third wires each having a first end passing over a roller which is suspended by the second end of each of the second wires to securely connect to a side face of the outer frame and a second end extending through a side face of the inner frame so as to form the first loop with the second end of the other third wire.

13. The criminal arresting assembly as claimed in claim 12, wherein the second loop is composed of two opposite fourth wires each having a first end securely connected to a top face of a corresponding second weight and a second end passing through the corresponding one of the second weight and a side face of the outer frame so as to form the second loop with the second end of the other fourth wire.

14. A criminal arresting method comprising;

preparing a frame assembly composed of a main frame, an inner frame slidably received in the main frame and an outer frame supporting the inner frame and slidably received in the main frame;

activating a first weight releasing device and descent of the outer frame to allow a first weight formed on the outer frame to fall relative to the frame assembly;

activating reducing size of a first loop inside the frame assembly for enclosing a criminal's upper half;

activating a second weight releasing device and descent of the inner frame to allow a second weight to fall relative to the frame assembly; and activating reducing size of a second loop inside the frame assembly for enclosing the criminal's lower half.

15. The method as claimed in claim 14, wherein the inner frame is supported by and spaced away from the outer frame by spacers formed on side faces of the outer frame.

16. The method as claimed in claim 15, wherein the first weight releasing device activating step includes energizing an electromagnetic valve;

pivoting a lever which is pivotally connected to a top portion of the main frame; and releasing the first weight.

17. The method as claimed in claim 16, wherein the first loop size reducing activating step includes stopping travelling of the inner frame by first wires each having a first end securely and fixedly connected to the top portion of the main frame and a second end securely connected to side faces of the inner frame;

stopping travelling of the outer frame by a combination of a pair of opposite second wires and a pair of opposite third wires, each second wire having a first end securely and fixedly connected to the top portion of the main frame and a second end provided with a first roller, and each third wire having a first end securely and fixedly connected to a side face of the outer frame and a second end passing over the first roller and a side face of the inner frame to form the first loop with the second end of the other third wire.

18. The method as claimed in claim 17, wherein the second weight releasing device activating step includes activating movement of a driving rod which is mounted on the top portion of the main frame; and pivoting a driven rod to allow a second claw formed on a free end of the driven rod to release clamping to the second weight.

19. The method as claimed in claim 18, wherein the second loop is composed of a pair of opposite fourth wires each having a first end securely and slidably connected to the top portion of the main frame and a second end passing through the second weight and a side face of the outer frame to form the second loop with the second end of the other fourth wire.

20. The method as claimed in claim 17, wherein the second ends of the opposite pair of third wires are connected to each other by a slipknot to form the first loop.

21. The method as claimed in claim 19, wherein the second ends of the opposite pair of fourth wires are connected to each other by a slipknot to form the second loop.

* * * * *